US005857651A

United States Patent [19]

Kunevicius

[11] Patent Number: 5,857,651

[45] Date of Patent: Jan. 12, 1999

[54] BOW HOLDING DEVICE

[75] Inventor: Richard J. Kunevicius, Solon, Ohio

[73] Assignee: Kane Products, Inc., Cleveland, Ohio

[21] Appl. No.: 762,313

[22] Filed: Dec. 9, 1996

[51] Int. Cl.[6] ..... A47B 96/06

[52] U.S. Cl. ..... 248/230.8; 248/218.4; 248/298.1

[58] Field of Search ..... 248/230.8, 218.4, 248/219.2, 219.4, 227.3, 230.1, 276.1, 279.1, 286.1, 284.1, 298.1, 299.1, 309.1; 124/1, 86, 23.1; 182/90, 91, 92, 187

[56] References Cited

U.S. PATENT DOCUMENTS

| | | | |
|---|---|---|---|
| 786,600 | 4/1905 | Rowlett | 248/279.1 |
| 910,189 | 1/1909 | Fox | 248/299.1 |
| 1,537,772 | 5/1925 | Hitzler | 248/279.1 |
| 3,490,600 | 1/1970 | Reed et al. | 248/284.1 |
| 4,722,501 | 2/1988 | Ruhl | 248/230.8 |
| 5,071,098 | 12/1991 | Aldridge | 248/219.2 |
| 5,117,779 | 6/1992 | Karow | 248/230.8 |
| 5,310,151 | 5/1994 | Engel | 248/219.4 |
| 5,482,241 | 1/1996 | Oglesby | 248/309.1 |
| 5,622,342 | 4/1997 | Mills | 248/558 |

OTHER PUBLICATIONS

*Cabela's* 1994 Annual Fall Catalog, p. 258.

*Primary Examiner*—Leslie A. Braun
*Assistant Examiner*—Gwendolyn Baxter
*Attorney, Agent, or Firm*—D. Peter Hochberg

[57] ABSTRACT

A compact, foldable holding device for holding a bow or other weapon from a tree. A telescoping bracket member allows for convenient adjustment of the holding position. The holding device does not scar the tree and provides convenient storage of the bow or other weapon while waiting for game to approach. Moreover, the holding device allows for quick and easy movement of the bow or other weapon to an aiming position.

17 Claims, 6 Drawing Sheets

BOW HOLDING DEVICE

FIELD OF THE INVENTION

The present invention relates generally to a holding device, and more particularly to a compact, portable holding device for hanging a bow, gun or the like from a tree.

BACKGROUND OF THE INVENTION

Hunters often wait long periods of time for game to approach. In many cases, the hunter waits lip in a tree using a tree stand. If the hunter has no device to hold their bow (or gun, etc.) during these long waits, the hunter is greatly inconvenienced, and in some cases, the ability of the hunter to successfully shoot the game when it does finally approach is impaired. In this regard, when a hunter is using a tree stand, there is limited storage space, and only a narrow range of motion is possible. Accordingly, the hunter has few storage options while waiting for game to approach. Without the use of a holding device, the hunter must keep the bow across his lap, which can be very uncomfortable and inconvenient. In this respect, the hunter cannot easily move around to eat and drink. Moreover, keeping the bow across the hunter's lap substantially increases the time needed to aim the weapon when game finally does approach. In addition, since the process of moving the bow to an aiming position requires a significant amount of motion, the hunter may inadvertently alert the game of the hunter's presence, thus losing an opportunity to shoot the game.

The prior art has provided few Solutions to the foregoing problems. The simplest solution has been to insert a long screw into the tree and hang the bow from the screw. This solution has several drawbacks. First, the screw does not allow the bow to be positioned in a manner which is convenient for quickly moving the bow to an aiming position. Furthermore, a long screw may not provide sufficient support for the bow, causing the bow to fall from the tree. Moreover, the screw will scar the tree, which is prohibited in some jurisdictions.

A second prior art solution to the foregoing problems has been to provide an L-bracket with a screw portion for screwing the L-bracket into a tree. While this device may provide better support for the bow, it does not place the bow in a position that allows the bow to he quickly placed in an aiming position. Moreover, the portion of the L-bracket extending perpendicular to the longitudinal axis of the tree is not adjustable. This device also scars the tree.

Yet another solution to the foregoing problems has been to mount a holding device to the tree stand itself. This device receives the bottom of the blow. However, since this holding device must be mounted to the base of the tree stand, it does not allow for adjustable height. Therefore, the bow will be in an inconvenient position for quick movement to the aiming position. This type of holding device may also require a large range of motion in order for the hunter to reach the bow and aim it. Moreover, this type of holding device can only be used if a tree stand is being used. Therefore, such a holding device cannot be used if a hunter wishes to position himself on the ground at the base of a tree.

The present invention overcomes these and other drawbacks of prior art devices and provides a holding device which is compact, portable, provides a large range of holding positions, and which is convenient to use.

SUMMARY OF THE INVENTION

According to tile present invention, there is provided a holding device attachable to a tree for holding a bow, gun or the like, including a first bracket means for bracing the holding device against a tree, a second bracket means extending transverse to the first bracket means, and generally perpendicular to the longitudinal axis of the tree, and a third bracket means extending transverse to the first and second bracket means, being engageable with the bow, gun or the like.

It is an object of the present invention to provide a holding device for holding a bow, gun or the like.

It is another object of the present invention to provide a holding device which allows a bow, gun or the like to be positioned in a manner which is convenient for both right-handed and left-handed individuals.

It is another object of the present invention to provide a holding device which does not damage or scar the tree to which it is mounted.

It is yet another object of the present invention to provide a holding device which is lightweight, compact and portable.

It is yet another object of the present invention to provide a holding device which allows a hunter to quickly move a bow or gun to an aiming position when game approaches.

It is still another object of the present invention to provide a holding device which allows for a large range of positions for holding the bow or gun.

It is still another object of the present invention to provide a holding device which does not require tools for assembly and configuration.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE PREFERRED EMBODIMENT

Figure 1:
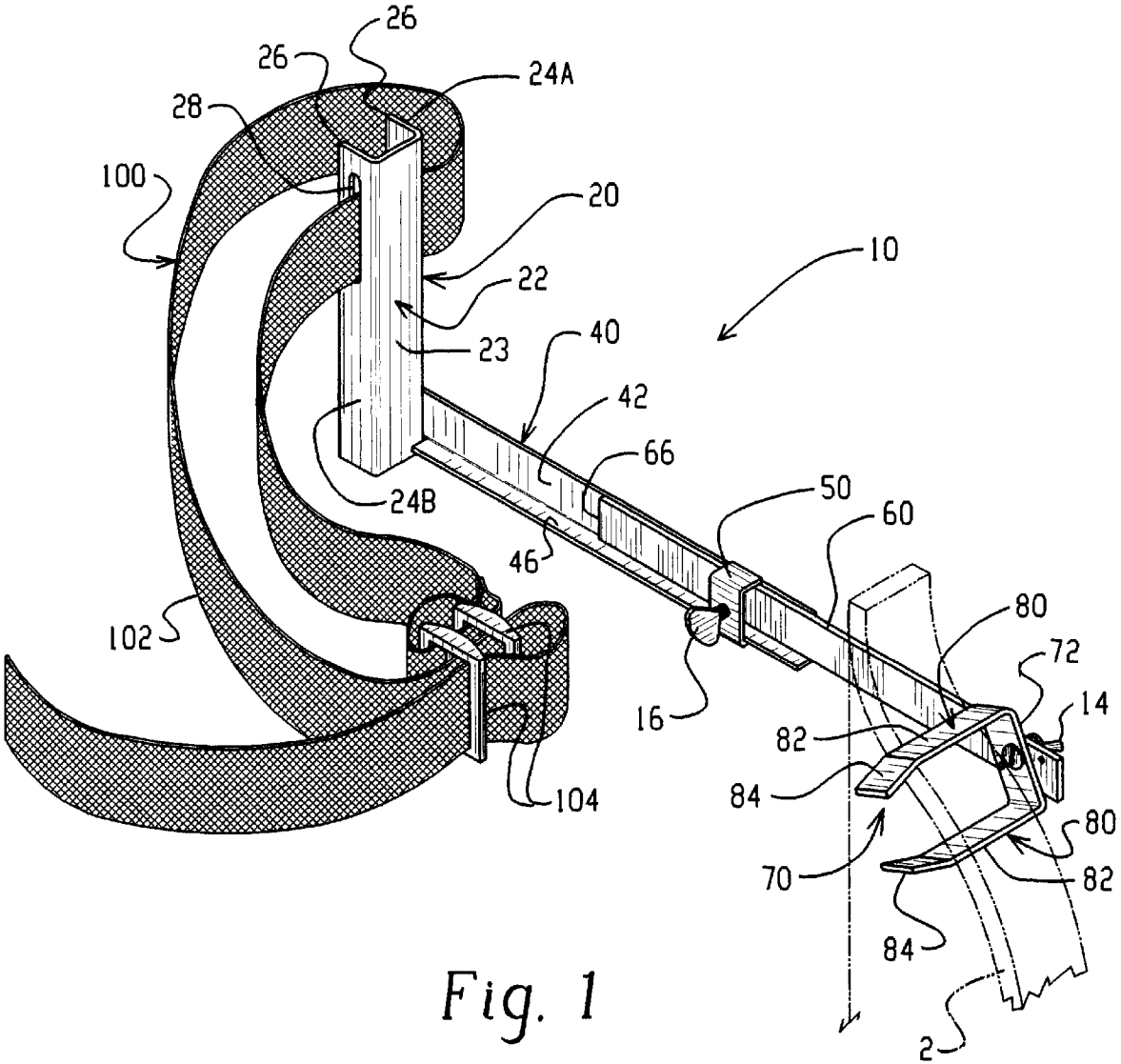
FIG. 1 is a perspective view of a holding device illustrating a preferred embodiment of the present invention.

Referring now to the drawings wherein the showing is for the purpose of illustrating a preferred embodiment of the invention only, and not for the purpose of limiting same, FIG. 1 shows a perspective view of a holding device 10 holding a bow 2 shown in phantom. Bow 2 typically weighs between 4 and 6 pounds, and has a length of approximately 35–45 inches. In general, bow 2 is oriented such that the bow string is nearly vertical. Holding device 10 is dimensioned to hold a variety of different bows including compound bows, traditional bows, and long bows. Holding device 10 is generally comprised of an elongated U-bracket member 20, an L-bracket member 40, a sliding bracket member 60 and a C-bracket member 70. U-bracket member 20 mounts against a tree to brace holding device 10 thereagainst. Bracket member 60 slides relative to L-bracket member 40 to adjust the distance of C-bracket member 70 from U-bracket member 20. Therefore, the distance of C-bracket member 70 from the tree is adjustable. C-bracket member 70 engages with the bow (or other weapon, such as a gun) to support the bow in a position which allows for quick and convenient access by a hunter.

Figure 6:
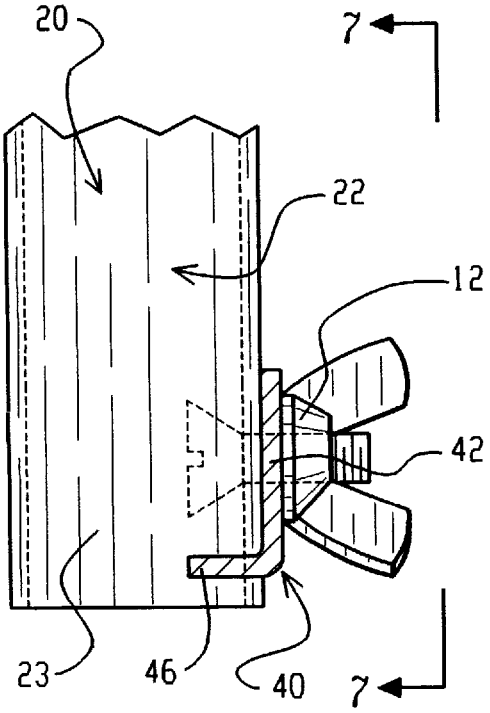
FIG. 6 is a sectional view taken along line 6—6 of FIG. 2.
Figure 7:
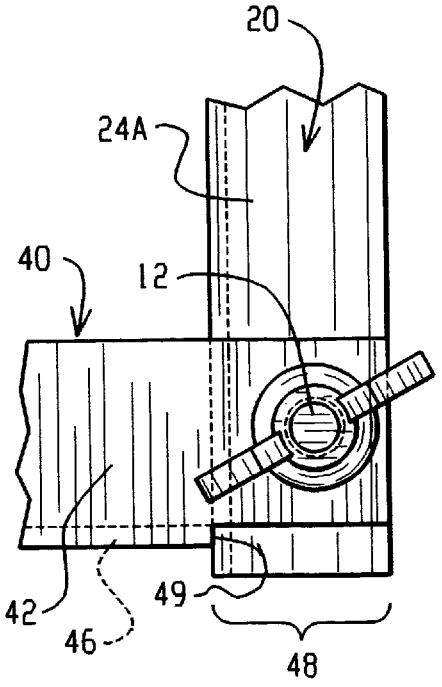
FIG. 7 is a side plan view taken along line 7—7 of FIG. 6.

Elongated U-bracket member 20 will now be described in detail with reference to FIG. 2, which provides an enlarged perspective view of holding device 10. U-bracket member 20 is basically comprised of a generally planar center wall 22 and side walls 24A and 24B. Center wall 22 has a front face 23, which engages with a portion of L-bracket member 40, as will be described below. Side walls 24A and 24B are generally perpendicular to center wall 22, and include edges 26. Edges 26 engage with a tree to brace holding device 10 thereagainst. While edges 26 are shown as having smooth surfaces, it should be appreciated that teeth may be formed in edges 26 to provide additional gripping surfaces. It should further be appreciated that the width of center wall 22 could be modified to increase the distance between edges 26. As a result, the stability of holding device 10 may be improved as it rests against the tree. This reduces or eliminates any possible wobble when holding device 10 is mounted to a tree. Slots 28 are formed in side walls 24A, 24B and are dimensioned to receive strap means 100, which will be described in detail below. A hole is formed in side wall 24A for attaching U-bracket member 20 to L-bracket member 40 using a fastener 12, as will be described below (see FIGS. 6 and 7).

Figure 5:
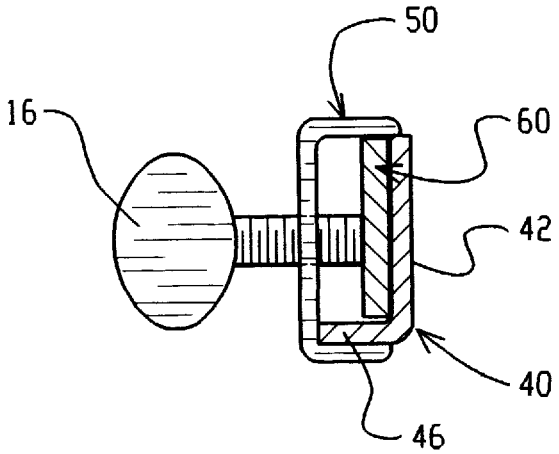
FIG. 5 is a sectional view taken along line 5—5 of FIG. 2.

As mentioned above, U-bracket member 20 is fixed to L-bracket member 40. L-bracket member 40 is generally comprised of a vertical portion 42, a horizontal portion 46 and a guide band 50. A hole is formed in vertical portion 42 for attaching U-bracket member 20 to L-bracket member 40 using fastener 12 (see FIGS. 6 and 7). Fastener 12 is preferably a screw having a wing nut. The use of wing nuts eliminates the need for tools to loosen and tighten fastener 12. It should be appreciated that fastener 12 could be replaced with a spring-loaded locking button. Horizontal portion 46 is generally perpendicular to vertical portion 42. It should be noted that horizontal portion 46 does not extend the entire length of vertical portion 42. In this respect, horizontal portion 46 provides a gap 48 for receiving U-bracket member 20 in the unfolded position (see FIG. 7). Gap 48 forms an edge 49 which engages with front face 23 of U-bracket member 20 to support L-bracket member 40 in the unfolded position. Referring now to FIG. 5, guide band 50 extends from the outer edge of horizontal portion 46 to the outer edge of vertical portion 42. Guide band 50 and horizontal portion 46 form a slot to guide sliding bracket member 60 as it is moved relative to L-bracket member 40. Sliding bracket member 60 will now be described below. A threaded hole is formed in guide band 50 for receiving a locking member 16, which engages with sliding bracket member 60 to fix sliding bracket member 60 relative to L-bracket member 40. Locking member 16 is preferably a thumb screw. The use of a thumb screw eliminates the need for tools to loosen and tighten locking member 16.

Figure 3:
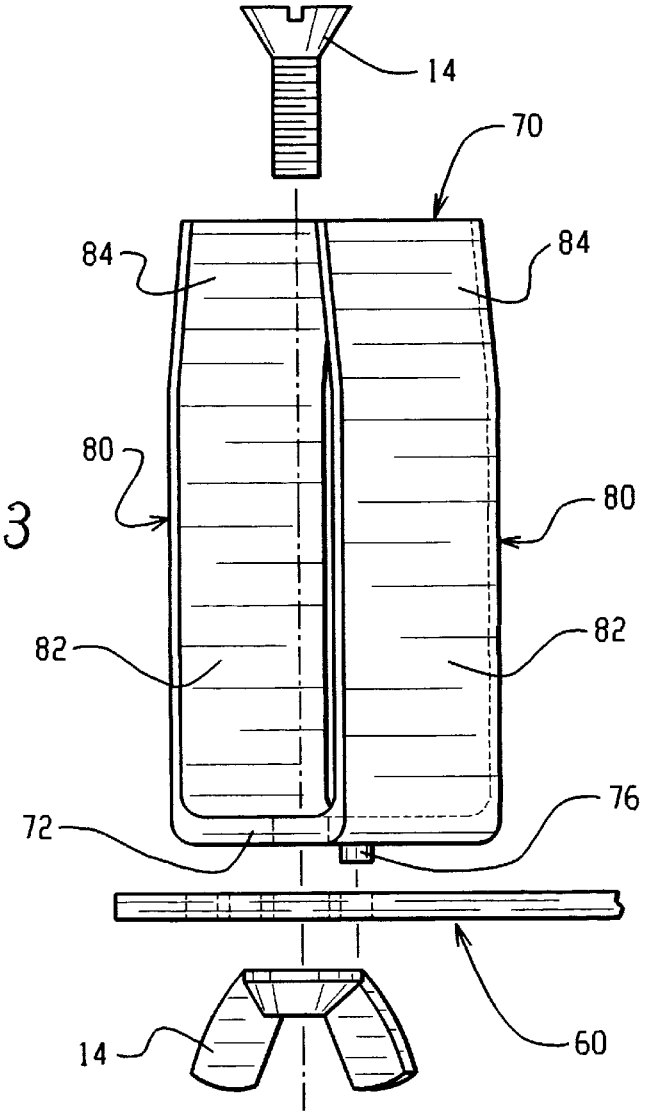
FIG. 3 is an exploded plan view of a C-bracket member of the holding device shown in FIG., 1.
Figure 4:
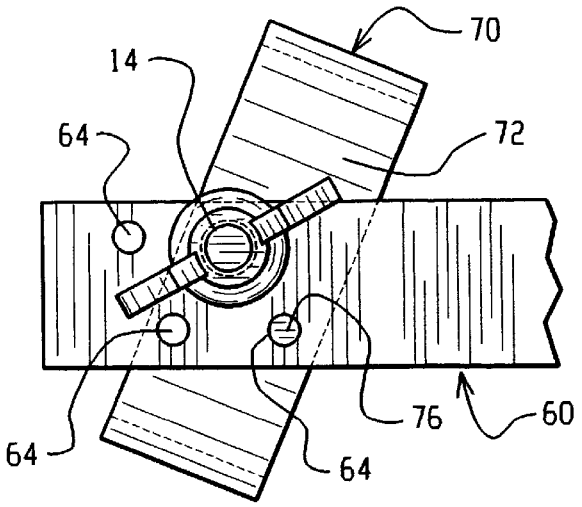
FIG. 4 is a side plan view of the C-bracket member as attached to a sliding bracket member.

Sliding bracket member 60 is generally planar, and is movable relative to L-bracket member 40 to provide a telescoping bracket. Referring now to FIGS. 3 and 4, a hole is formed in sliding bracket member 60 for attaching C-bracket member 70 to sliding bracket member 60 using a fastener 14, as will be explained below. In addition, a plurality of holes 64 are formed in sliding bracket member 60 to receive a locking member 76 of C-bracket member 70. Locking member 76 will be described in detail below. It should be appreciated that a shoulder could be formed at edge 66 of sliding bracket member 60 to prevent overextension. Moreover, a slot or notch 68 could also be formed in edge 66 to receive fastener 12 when sliding bracket member 60 is in a fully retracted position for storage (see FIG. 10).

Figure 2:
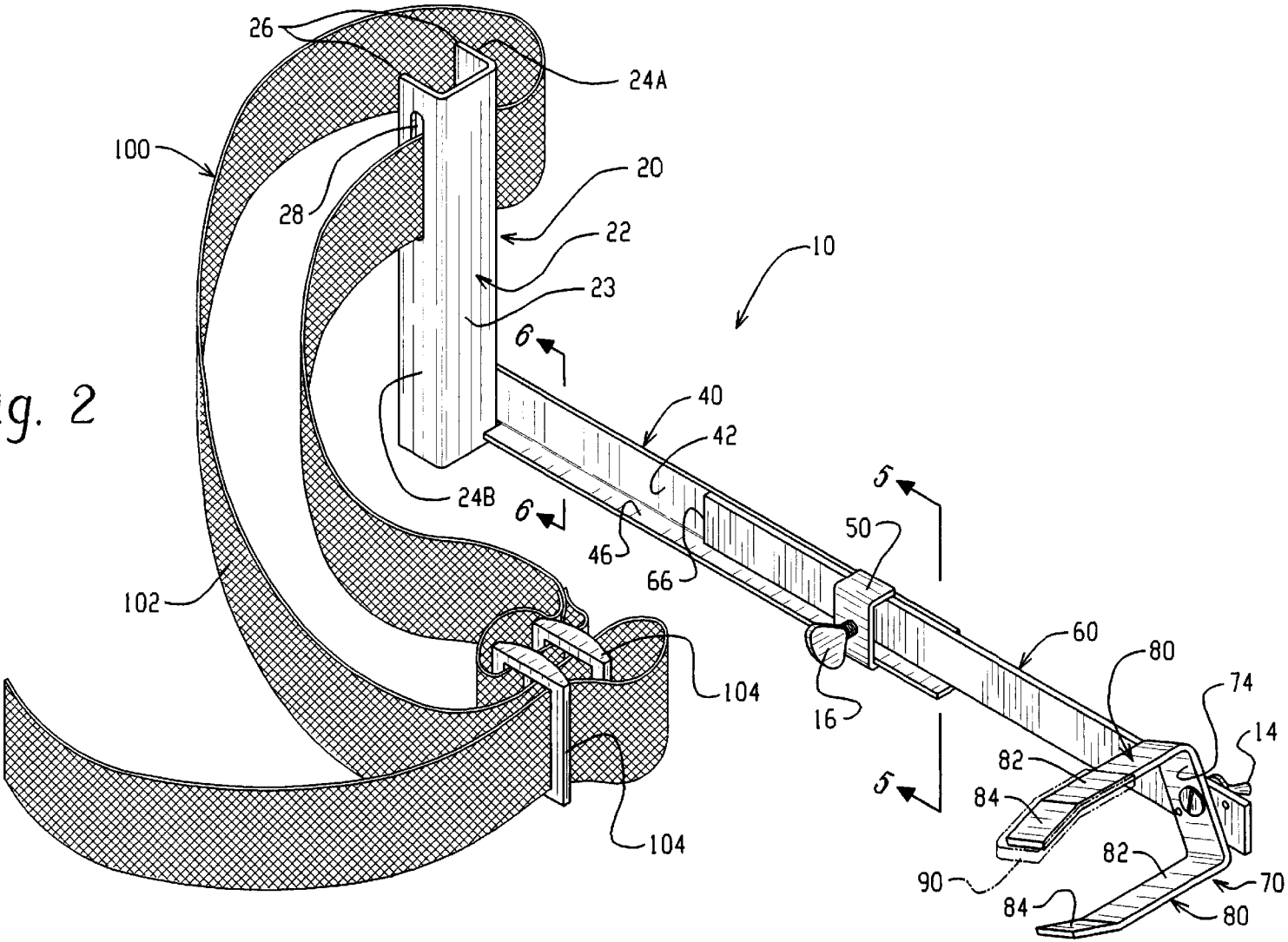
FIG. 2 is an enlarged perspective view of the holding device shown in FIG. 1.

As can best be seen in FIGS. 1 and 2, C-bracket member 70 is generally comprised of a central portion 72 and a pair of arms 80. Central portion 72 is generally planar, and includes the above-mentioned locking member 76, and a hole for receiving fastener 14 to attach C-bracket member 70 to sliding bracket member 60 (see FIGS. 3 and 4). Fastener 14 is preferably a screw having a wing nut. It should be appreciated that fastener 14 could be replaced with a spring-loaded locking button. Locking member 76, which is formed in central portion 72, engages with the surfaces formed by holes 64 of sliding bracket member 60. Accordingly, C-bracket member 70 can be locked in a plurality of positions relative to sliding bracket member 60. Arms 80 are each comprised of a first portion 82 and a second portion 84. First portions 82 are generally perpendicular to central portion 72. Second portions 84 are angled inward relative to first portions 82. This provides an additional gripping surface, as will be explained below. It should be appreciated that caps 90, made of plastic or rubber, may be slid over arms 80 to protect the weapon held by holding device 10 from scratches. In addition, caps 90 provide higher friction gripping surfaces for holding the bow.

Strap means 100 is comprised of a strap member 102 and tri-glides 104. Strap member 102 is threaded through elongated slots 28 of U-bracket member 20, and looped through a pair of tri-glides 104, as shown in FIGS. 1 and 2. Tri-glides 104 are preferably made of plastic to obtain a tight fit. However, metal buckles are also suitable. Strap member 102 has a length sufficient to loop around a typical tree capable of supporting an individual in a tree stand. Therefore, strap member 102 typically has a length of between approximately three to five feet. Strap member 102 is preferably constructed of a soft webbing material which stretches for a tight fit.

Operation of holding device 10 will now be described in detail. Strap means 100 is looped around a tree and tightened. Accordingly, edges 26 of U-bracket member 20 will brace against the surface of a tree. Sliding bracket member 60 is extended forward from the tree, by loosening locking member 16 and sliding bracket member 60 relative to L-bracket member 40. Locking member 16 is then tightened when a desired position is reached, in order to fix the position of sliding bracket member 60. Fastener 14 is loosened so that C-bracket member 70 can be rotated to a desired position, wherein locking member 76 engages with one of the holes 64 of sliding bracket member 60. Typically, C-bracket member 70 will be rotated from its storage position shown in FIG. 10 to a position wherein arm 80 closest to U-bracket member 20 is above arm 80 furthest from U-bracket member 20, (see FIGS. 1 and 2). Fastener 14 is then tightened to fix the position of C-bracket member 70.

Figure 8:
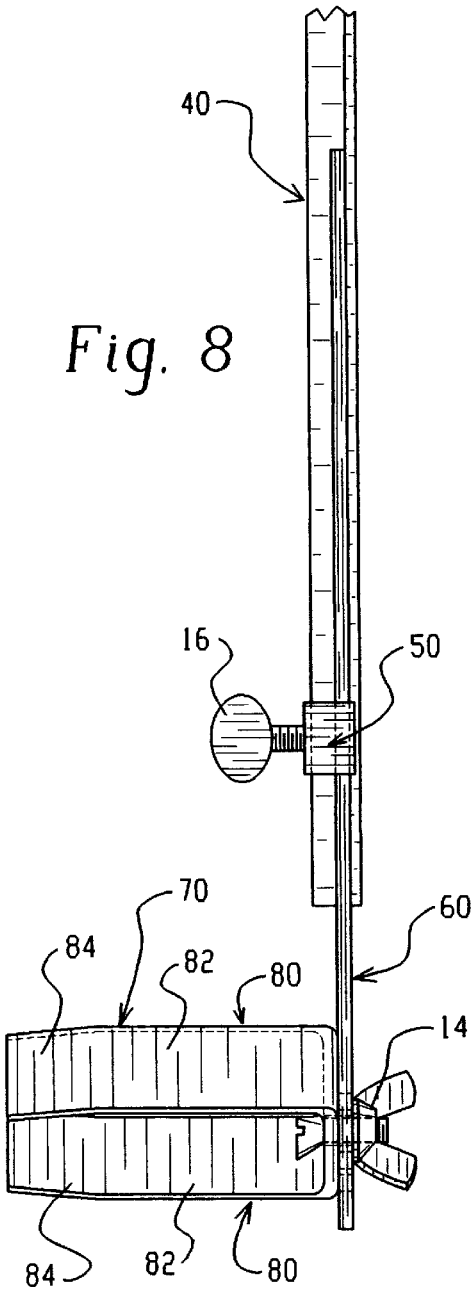
FIG. 8 is a top plan view of a portion of the holding device, as configured for use by right-handed individuals.
Figure 9:
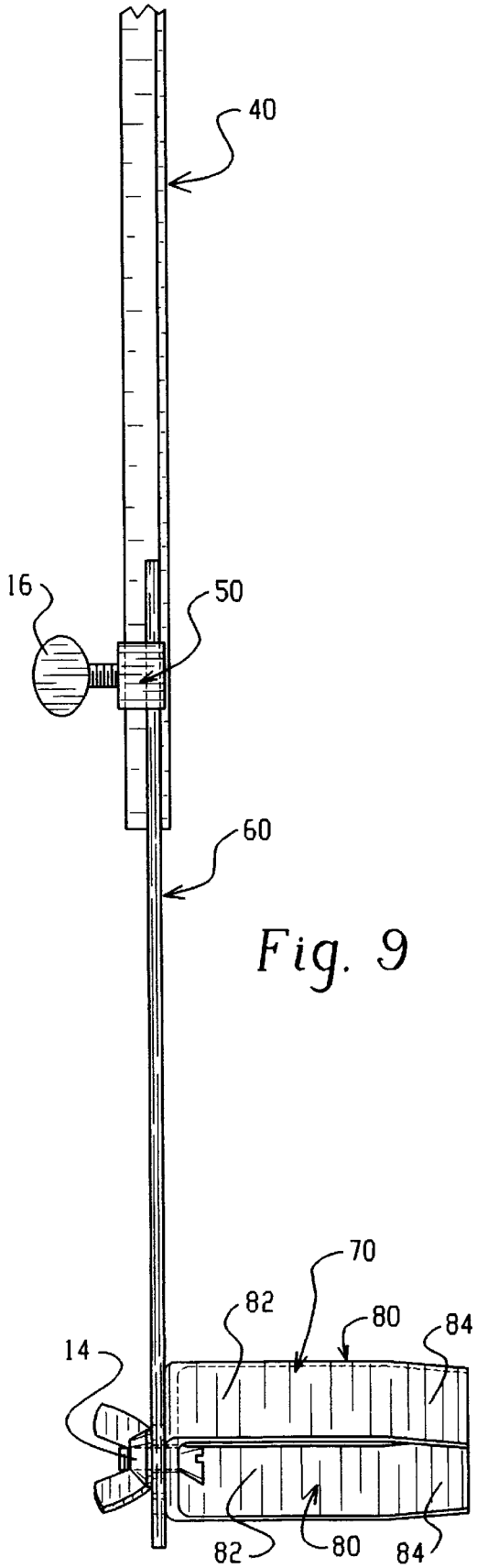
FIG. 9 is a top plan view of a portion of the holding device, as configured for use by left-handed individuals.

It should be appreciated that FIGS. 1, 2 and 8 illustrate holding device 10 as configured for use by right-handed individuals. FIG. 9 illustrates holding device 10 as configured for use by left-handed individuals. Holding device 10 may be easily re-configured for convenient use by left-handed individuals in one of two ways. In the first method, C-bracket member 70 is detached from sliding bracket member 60 and reattached on the opposite side of sliding bracket member 60, as shown in FIG. 9. In the second method, sliding bracket member 60 is slid out from under guide band 50 and rotated 180 degrees. Thereafter, it is slid back under guide band 50 to the position shown in FIG. 9.

Figure 10:
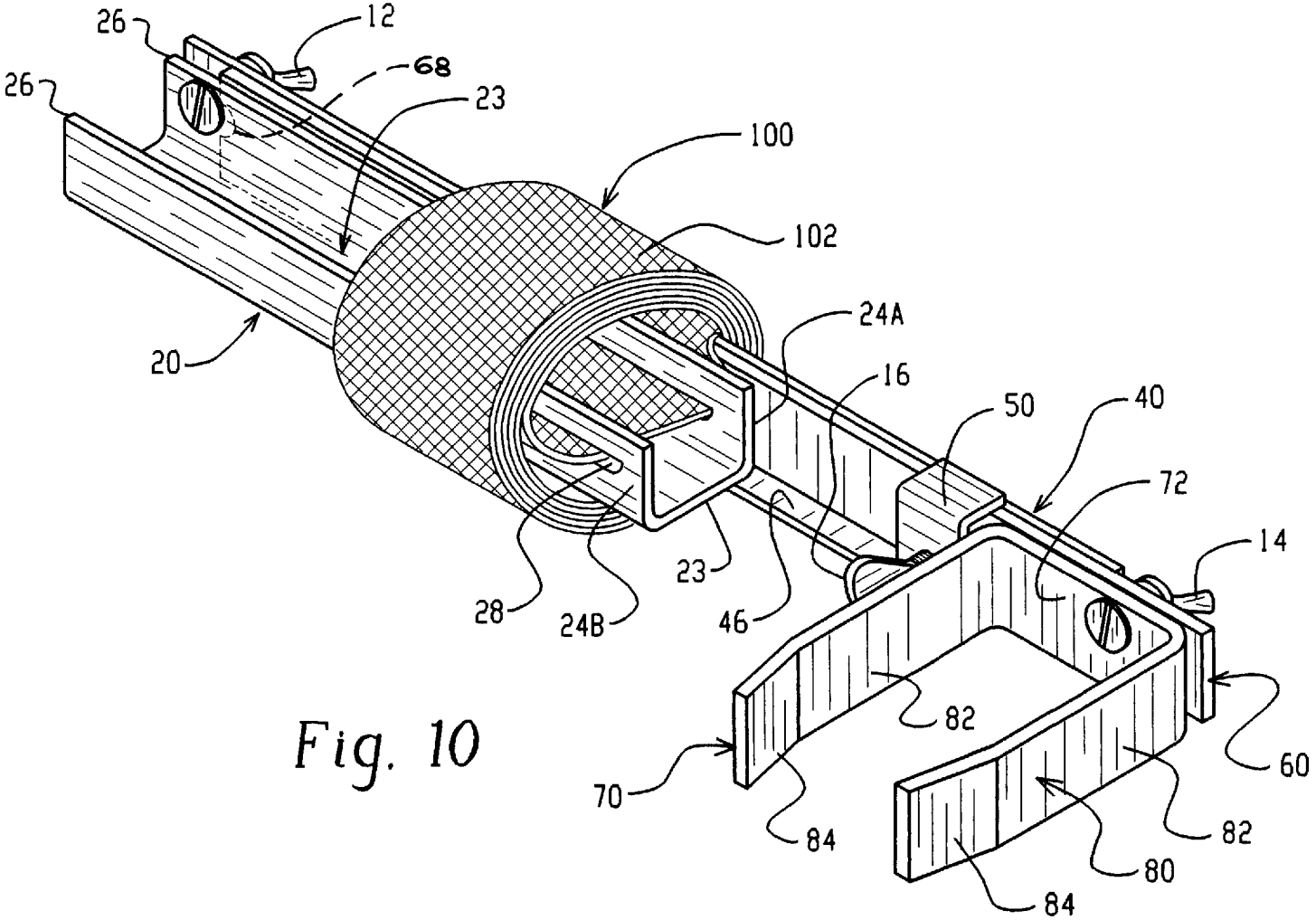
FIG. 10 is a perspective view of the holding device as folded for storage.

FIG. 10 shows holding device 10 as folded for compact storage in a backpack or fanny-pack. In this respect, locking member 16 is loosened and C-bracket member 70 is rotated to the position shown in FIG. 10. Fastener 14 is then re-tightened. Next, locking member 16 is loosened and sliding bracket member 60 is retracted inward towards U-bracket member 20. Locking member 16 is then re-tightened to secure sliding bracket member 60 in its retracted position. Next, fastener 12 is loosened and U-bracket member 20 is rotated downwards, such that a portion of front face 23 rests upon horizontal portion 46 of L-bracket member 40. Strap means 100 can then be conveniently wrapped in the manner shown in FIG. 10.

Holding device 10 is preferably made of steel, aluminum, or high-strength plastic. However, other high-strength materials are also suitable. Moreover, holding device may be coated with a camouflage pattern to prevent the device from being easily spotted by game.

It should be appreciated that holding device 10 is also suitable for use as a rifle sling to hold gins or other hunting weapons. In this respect, a gun having a strap can be hung from C-bracket member 70. In this case, the gun strap is hooked upon C-bracket member 70. In the case of holding a gun, C-bracket member 70 could be modified to have only one arm 80.

The foregoing description is a specific embodiment of the present invention. It should be appreciated that this embodiment is described for purposes of illustration only, and that numerous alterations and modifications may be practiced by those skilled in the art without departing from the spirit and scope of the invention. For instance, holding device 10 could be modified to eliminate strap means 100, and replace it with a screw member for screwing holding device 10 directly into a tree. It is intended that all such modifications and alterations be included insofar as they come within the scope of the invention as claimed or the equivalents thereof.

The invention claimed is:

1. A holding device attachable to a tree for holding a bow, gun or the like comprising:

a first bracket means for bracing said holding device against the tree;

a second bracket means for extending said bow, gun or the like away from the tree, said second bracket means extending transverse to said first bracket means and generally perpendicular to the longitudinal axis of the tree, said first bracket means being rotatable about an axis generally perpindicular to said second bracket means, wherein said holding device being foldable into said second bracket means and said second bracket means surrounding at least part of said first bracket means when in a folded position; and a third bracket means for engaging with said bow, gun or the like, said third bracket means extending transverse to said first and second bracket means.

2. The holding device according to claim 1, wherein said second bracket means has an adjustable length.

3. The holding device according to claim 2, wherein said second bracket means is comprised of first and second bracket members.

4. The holding device according to claim 3, wherein said first bracket member of said second bracket means is an L-shaped bracket.

5. The holding device according to claim 4, wherein said first bracket member further includes a notch on the end connected to said first bracket means to allow said first member means to rotate about said axis.

6. The holding device according to claim 3, wherein said second bracket member is a slidably bracket releasable engageable in said first bracket member by use of a guide band, said second bracket member having a first position for right-handed individuals and a second position for left-handed individuals wherein said second bracket member is slid out from under said guide band from said first position for right-handed individuals and rotated 180 degrees and thereafter slid back under said guide band to said second position for left-handed individuals.

7. The holding device according to claim 1, wherein said third bracket means is comprised of at least one arm means for supporting said bow, gun or the like.

8. The holding device according to claim 7, wherein said third bracket means is a C-bracket member having two-arm means for supporting said bow, gun or the like.

9. The holding device according to claim 8, wherein said C-bracket member comprises:

a central member having two ends;

said two arm means each having a parallel opposing side portion each being integral and generally perpendicular to one of said ends of said central member and said two arm means each having an inwardly converging end portion being integral with one of said side portions.

10. The holding device according to claim 7, wherein said third bracket means is rotatable about an axis generally perpendicular to said second bracket means.

11. The holding device according to claim 1, wherein said first bracket means is an elongated U-shaped bracket member having a pair of edges engageable with the tree to brace said holding device.

12. The holding device according to claim 11, wherein said first bracket means includes recess means for receiving a strap means for attaching said holding device to the tree.

13. The holding device according to claim 1, wherein said holding device further comprises a strap means for attaching said holding device to the tree.

14. The holding device according to claim 1, wherein said bow, gun or the like rests upon said third bracket member.

15. The holding device according to claim 1, wherein said third bracket means is releasable engageable in said second bracket means and said second bracket means has a first side and a second side, said third bracket means having a first position for right-handed individuals when said third bracket means is attached to said first side of said second bracket means and a second position for left-handed individuals when said third bracket means is attached to said second side of said second bracket means.

16. A holding device attachable to a tree for holding a bow, gun or the like, comprising:

a first bracket means for bracing said holding device against the tree;

a second bracket means for extending said bow, gun or the like away from the tree, said second bracket means having an adjustable length and extending transverse to said first bracket means and generally perpendicular to the longitudinal axis of the tree, said second bracket means being comprised of a first bracket member and second bracket member, said first bracket member, being an L-shaped bracket, said second bracket member being a slidably bracket releasable engageble in said first bracket member by use of a guide band, said second bracket member having a first position for right-handed individuals and a second position for left-handed individuals wherein said second bracket member is slid out from under said guide band from said first position for right-handed individuals and rotated 180° and thereafter slid back under said guide band to said second position for left-handed individuals; and a third bracket means for engaging with said bow, gun or the like, said third bracket means extending transverse to said first and second bracket means.

17. A holding device according to claim 16, wherein said third bracket means comprises:

a C-bracket member for engaging said bow, gun or the like, said C-bracket member extending transverse to said first and second bracket means.

* * * * *